United States Patent [19]

Dancy

[11] 4,348,963

[45] Sep. 14, 1982

[54] RETRACTABLE BULKHEADS FOR RAILROAD FLAT CARS

[76] Inventor: Curtis Dancy, 30903 S. Kaster Rd., Tracy, Calif. 95376

[21] Appl. No.: 201,572

[22] Filed: Oct. 28, 1980

[51] Int. Cl.[3] ..... B61D 17/06

[52] U.S. Cl. ..... 105/363; 105/238 R; 105/355; 105/378; 410/122

[58] Field of Search ..... 105/238 R, 355, 363, 105/378, 379, 381; 410/34, 38, 121–124, 127–129; 108/56.1; 220/1.5, 6, 7

[56] References Cited

U.S. PATENT DOCUMENTS

| | | | |
|---|---|---|---|
| 276,017 | 4/1883 | Foster | 105/363 |
| 896,031 | 8/1908 | Lillis et al. | 105/381 |
| 909,860 | 1/1909 | Apear | 105/363 X |
| 2,059,737 | 11/1936 | Mather | 105/378 X |
| 2,331,416 | 10/1943 | Muller, Sr. | 105/355 |
| 2,869,894 | 1/1959 | Messler | 105/381 X |
| 4,240,359 | 12/1980 | Howe | 105/381 X |

OTHER PUBLICATIONS

"Rock Island Builds Flat Car with Disappearing Bulkheads," *Railway Locomotives and Cars,* Jul. 1957, p. 43.

*Primary Examiner*—Randolph Reese
*Attorney, Agent, or Firm*—Mark C. Jacobs

[57] ABSTRACT

Retractable bulkheads for railroad flat cars which are normally in a vertical position spaced from one another on a railroad flat car for providing end to end supports for items stored on the flat cars is disclosed. The bulkheads are retractable to a folded or substantially parallel position with respect to the bed of the flat car when the flat car is empty to eliminate drag on the bulkheads when the flat car is in motion.

8 Claims, 6 Drawing Figures

RETRACTABLE BULKHEADS FOR RAILROAD FLAT CARS

BACKGROUND OF THE INVENTION

The invention relates to railroad flat cars; and, more particularly to collapsible or retractable bulkheads on a railroad flat car to eliminate drag on the same when the cars are in motion.

DESCRIPTION OF THE PRIOR ART

Railroad flat cars are generally provided with a substantially horizontal bed having wheels on the underside which travel on the track rails. Fixed upright bulkheads are usually provided at each end of the beds along the longitudinal axis thereof for providing bulkheads or support barriers when goods are stacked on top of the beds. Normally, there is no problem with flat beds of this type when goods are stacked on the beds between the bulkheads. However, when the beds are empty, there is a tendency of the empty flat beds to leave the tracks when the train exceeds a certain speed limit. This can of course cause derailment of the entire train. Although various theories have been suggested as to why this occurs, it is most likely because the fixed upright bulkheads provide a resistance to the wind during travel of the train whereby the wind moves over the leading bulkheads creating a turbulence between the bulkheads on the bed of the flat car. This lifts the flat car off the rails creating disrailment. For this reason, trains having empty flat cars are generally restricted to a top speed of 45 m.p.h., causing much lost time.

There is thus a need for an apparatus allowing empty flat cars to be pulled along rails at speeds in excess of 45 m.p.h. without lifting of the empty flat cars off of the rails, thus causing derailment.

SUMMARY OF THE INVENTION

It is an object of this invention to provide an apparatus for eliminating drag on the normally upright bulkheads of railroad flat cars during transport of the same when empty.

It is an object of this invention to carry out the foregoing object on preexisting rolling stock without substantial modification thereof.

It is a further object of this invention to provide a method for transporting empty railroad flat cars at speeds in excess of 45 m.p.h.

These and other objects are preferably accomplished by providing the spaced bulkheads on conventional flat cars with means for lowering the same to a retracted or folded position wherein drag on the bulkheads is eliminated when the flat car is in motion.

DESCRIPTION OF THE PREFERRED EMBODIMENT

Figure 1:
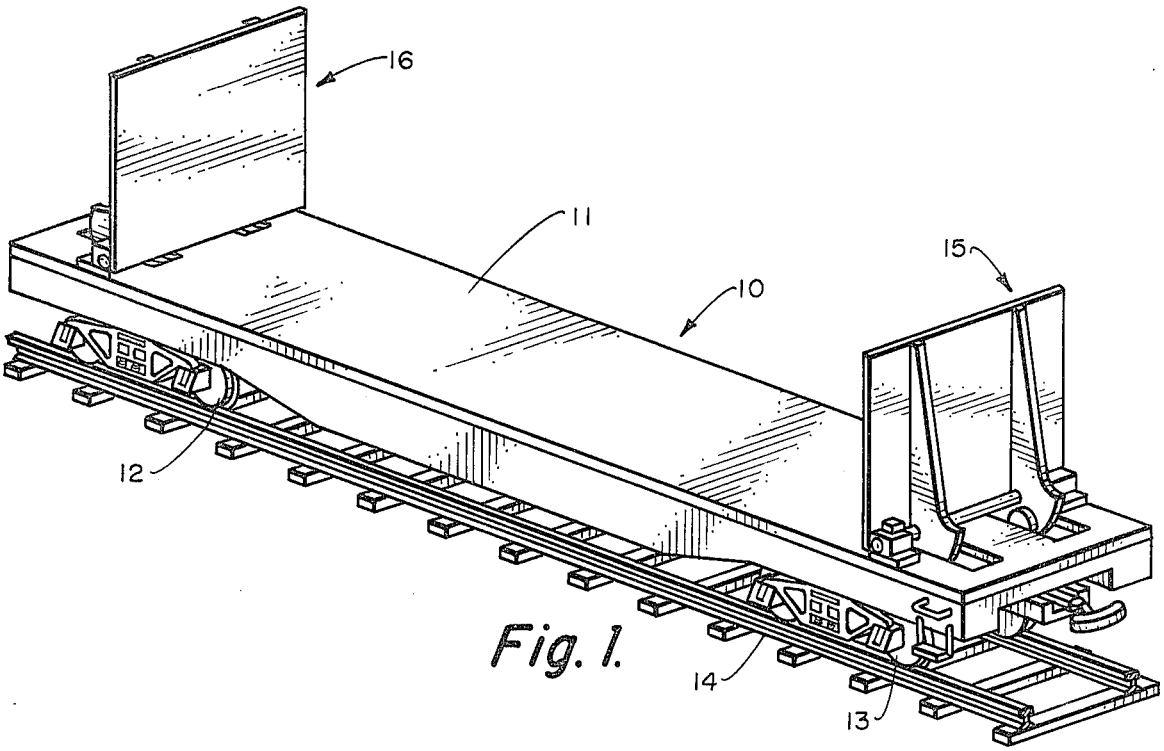
FIG. 1 is a perspective view of a railroad flat car in accordance with the invention.

Referring now to FIG. 1 of the drawings, a railroad flat car 10 in accordance with the teachings of the invention is shown having a flat bed 11 mounted on spaced wheeled trucks 12, 13 adapted to travel on rails 14. A pair of spaced upright bulkheads 15, 16 are provided at each end of flat bed 11 along the longitudinal axis thereof.

As shown in FIG. 1, each bulkhead 15,16 is substantially identical and may include planar upright member 17 (see FIG. 2) supported or strengthened by 2 supporting braces 18,18'. Braces 18,18' are fixedly secured to member 17 along the vertical extent thereof and include a rounded enlarged bottom portion 19.

Figure 2:
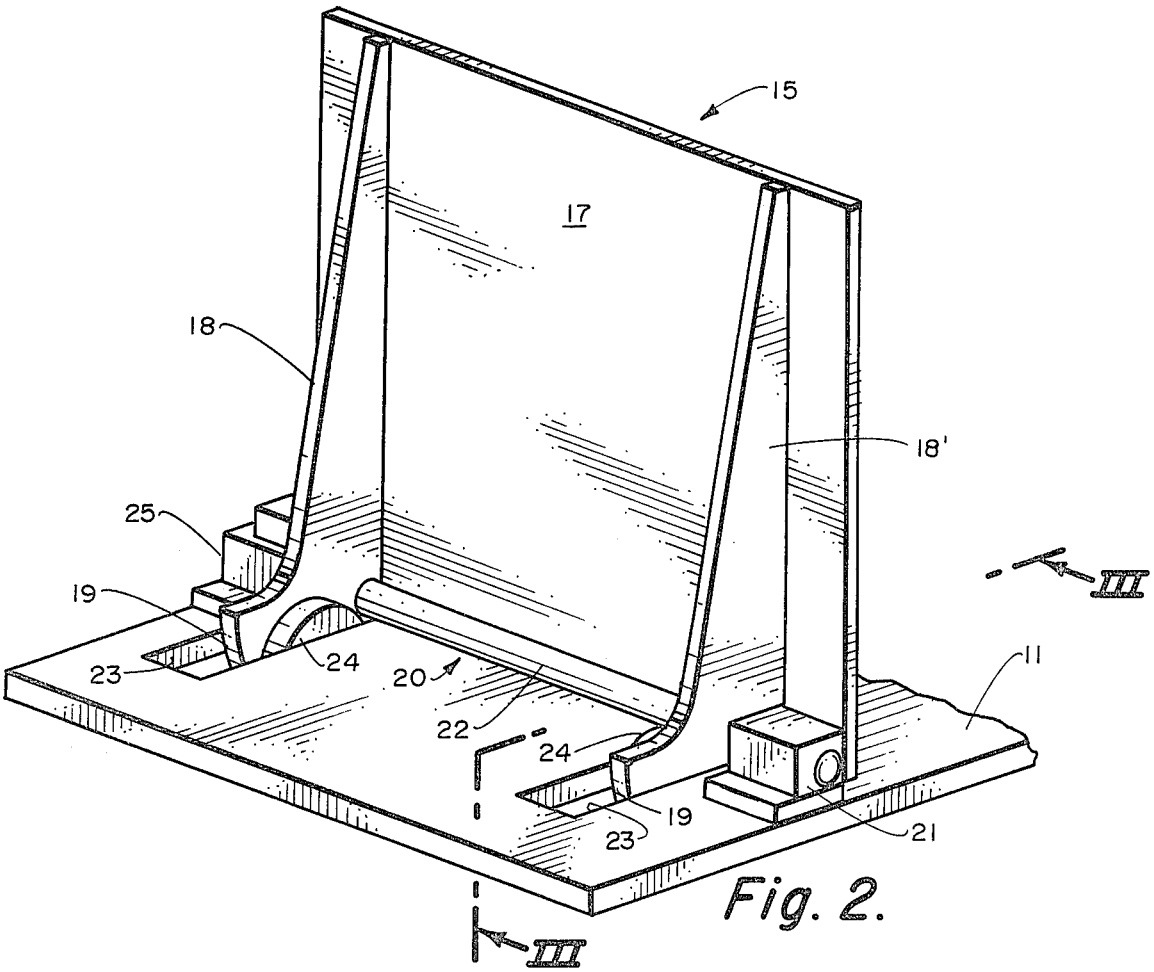
FIG. 2 is a perspective view of one of the bulkheads of the car of FIG. 1.
Figure 3:
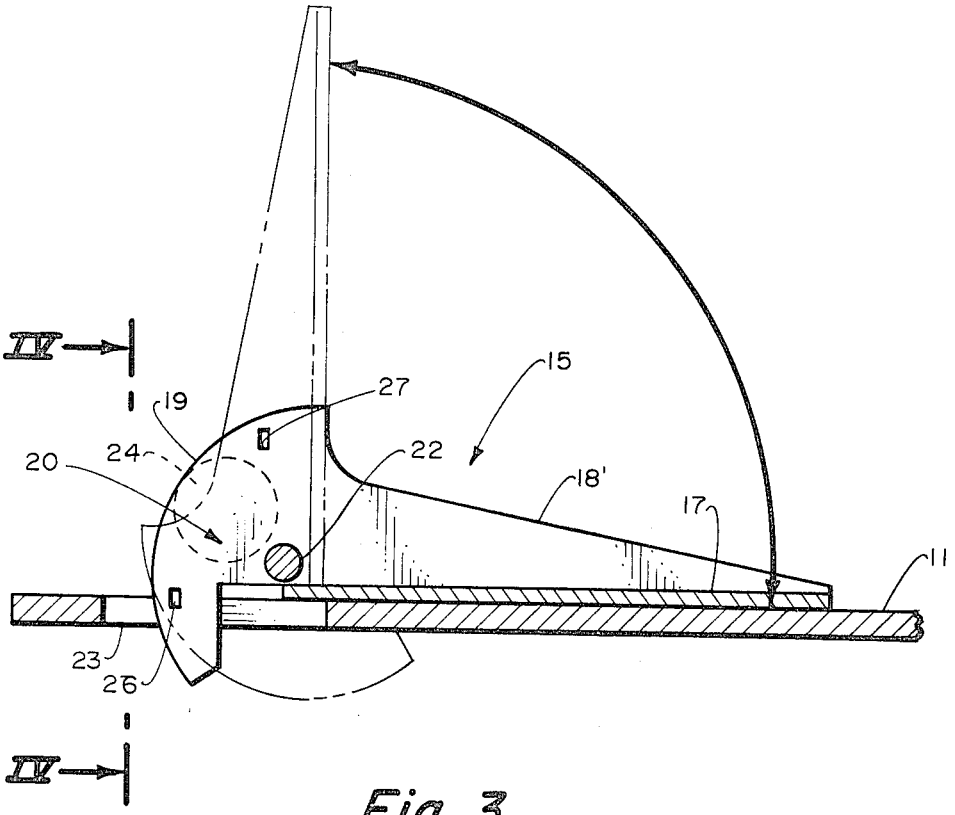
FIG. 3 is a side view of the bulkhead of FIG. 2 showing the same in a folded or retracted position.

In the exemplary embodiment of the invention, bulkhead moving means 20 are provided for moving bulkhead 15 from the normally upright position of FIGS. 1 and 2 to the retracted or folded position of FIG. 3. Such means 20 includes a housing 21 fixedly mounted on flat bed 11 rearwardly of each bulkhead 15,16. A rotatable rod 22 extends from housing 21 and is fixedly secured to the enlarged portion 19 of each brace 18. A cut out slot 23 is provided in bed 11 so that the bottom portion 19 of upright member 17 can rotate or revolve therein when bulkhead 15 moves to the FIG. 3 position.

As shown in FIG. 2, a weighted member 24 is provided on the inside of enlarged portion 19 adjacent rod 22 to act as a counterbalance for the bulkhead 15. Obviously, the weight of member 24 is preselected to provide the desired up and down movement of each bulkhead 15 or 16. Slot 23 is of course wide enough to accommodate member 24.

Figure 4:
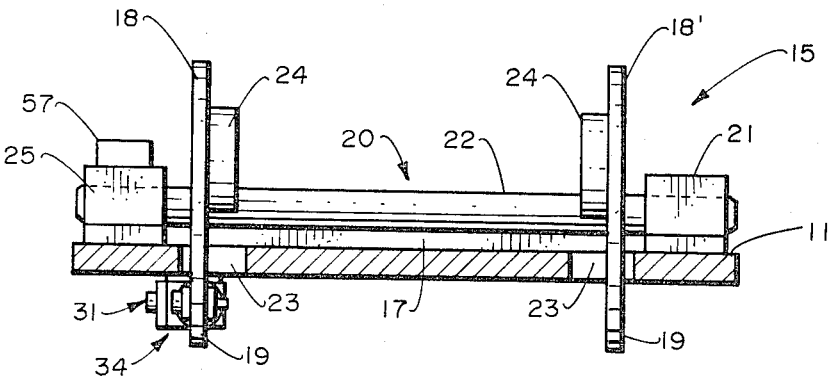
FIG. 4 is a view taken along lines IV—IV of FIG. 3.

Although any suitable means may be provided for actuating bulkheads 15,16 as shown in FIG. 4, a bearing housing 25 is mounted on the upper surface of bed 11 outside of member 17 having one end of rod 22 rotatably mounted therein. The rod 22 extends through a suitable aperture in portion 19, and may frictionally fit therein, or be braced on otherwise secured to portion 19, and into housing 21. Housings 21 and 25 provide bearing boxes for rod 22, and 25 includes piston 31's operating controls.

Figure 5:
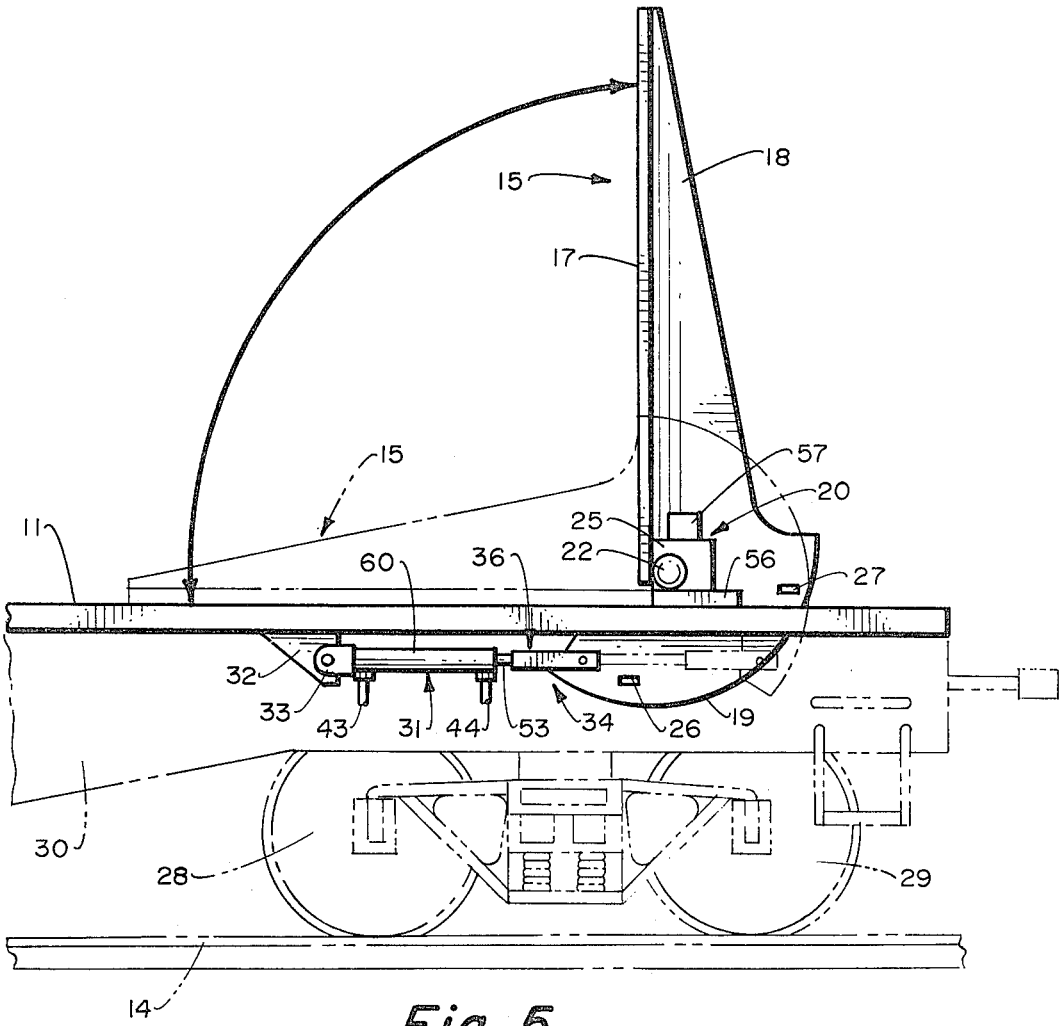
FIG. 5 is a vertical view, partly diagrammatic and with parts cutaway for convenience of illustration, of one of the bulkheads of FIG. 1.

As shown in FIG. 5, a pair of lock holes 26,27 are provided in the underside of portion 19 so that suitable lock bars (not shown) or the like may be inserted therein to lock the bulkheads in either the retracted or upright position.

As shown in FIG. 5, the distance between the bottom of enlarged portion 19 and the center of rod 22 is such that a space is provided between the bulkhead 15 and the bed 11 when the bulkhead 15 moves to the retracted position shown in dotted lines. This is to accommodate the bulkheads due to debris or wasted materials, referred to as donnage, remaining on the upper surface of bed 11.

The means for actuating the bulkheads 15,16 is also shown schematically in FIG. 5. Truck 13 includes conventional wheels 28,29 enclosed by skirts 30 as is well known in the art. An air piston 31 is mounted on the underside of bed 11 by a flange 33 pivotally mounted to support 32 by a threaded pivot pin 58 which is inserted through aperture 59 and which pin is threadedly received by support 32. Piston 31 includes a piston rod 53 reciprocal in cylinder 60 and extending therefrom to the bottom portion 19 of upright member 17 at connection 34. Also as shown in FIG. 5, the bearing housing 25 is raised about the upper surface 35 of bed 11 by a spacer block 56 or the like, e.g. about 6" or so, to provide the clearance between the bulkhead 15 and surface 35 when bulkhead 15 moves to the dotted line position of FIG. 5 as previously discussed.

Figure 6:
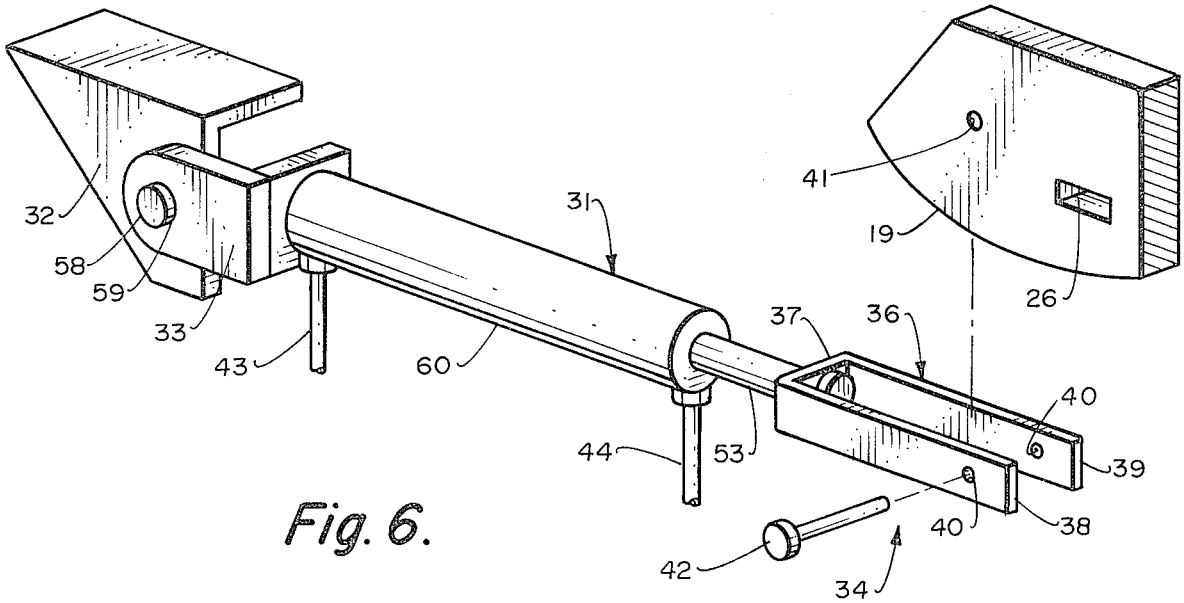
FIG. 6 is an exploded view of certain components of the actuating mechanism of FIG. 5.

Connection 34 is shown in detail in FIG. 6. Connection 34 is preferably detachably removable from the bottom portion 19 of upright member 17 and may comprise a device 36 having a base 37 secured to rod 53 and spaced arms 38,39 having aligned holes 40 therein. Portion 19 includes a like aperture 41 extending therethrough. Portion 19 is of a thickness to be inserted between arms 38,39 with a lock pin 42 insertible into aligned apertures 40,41 to lock arm 33 to upright member 17. Thus, piston 31 is quickly and easily coupled to each bulkhead 15,16. Control 57 on housing 25 operates piston 31.

The mechanism for piston 31 illustrated in FIG. 5 may be disposed internally of truck 13 with clamp 36 easily accessible from the exterior. When it is desired to lower each bulkhead 15,16 to the folded or retracted position, as evidenced by the dotted lines in FIG. 5, with device 36 coupled to each upright member 17 via pins 42, air is injected into piston 31 via air hose 43. Hose 43 is coupled to the conventional operating mechanism of car 10 (not shown) as is well known in the art. The injection of air into piston 31 moves rod 53 to the right in FIG. 5 moving bulkhead 15 about its axis (rod 22) in a counterclockwise direction to the dotted line position. Injection of air into piston 31 via hose 44, also coupled to the conventional air mechanism of car 10, moves rod 53 back to the FIG. 5 position (i.e. to the left in FIG. 5) thereby rotating bulkhead 15 about rod 22 in a clockwise direction in FIG. 5 to the solid line or upright position.

Bulkheads 15,16 may be of any suitable material, such as steel or the like, and may be additionally counterbalanced, 24 if desired. Alternatively, counterweights may be provided on axle or rod 22, if desired. The bulkheads may be of solid construction, of I-beams or the like, or cut-out, as desired, to reduce wind resistance. The bulkheads may also be provided with face plates if desired.

The dimensions of piston rod 53 may be selected to provide the necessary means for rotating each bulkhead, e.g. 30" in length with the body of piston 31 being about 8" in diameter. This will accomodate the normal 90 pounds of air pressure found on conventional rolling stock.

Although the distance between the central axes of rod 22 and the wheels of car 10 is selected to provide proper clearance on bed 11, the axes of each may be offset from each other horizontally to provide proper operation. For example, if rod 22 is 8" in diameter, a 31" throw of piston rod 53 is required. In such situation, the 8" rod 22 should be offset horizontally also 8" from the axle wheels 29 either forwardly or rearwardly.

The invention disclosed herein can be adapted to conventional flat beds by merely moving the bulkheads to a desired operating position and connecting up the mechanism disclosed herein via air hoses 43,44 to the air supply preexisting on the car.

The operating mechanism associated with piston 31 can be enclosed within the trucks of the car 10. Bulkheads 15,16 may of course, be constructed of lighter weight materials to cut down on weight and counterbalanced as necessary.

The holes 27,26 of each upright member 17 (two for each bulkhead) are aligned to permit insertion of the aforementioned locking member.

The air to piston 31 via hoses 43,44 may be controlled via suitable means, including a push button or the like, to be actuated easily and quickly when desired.

Rod 22 may be of any suitable material, e.g. a conventional 8" steel railroad axle capable of withstanding coupling impact.

It can be seen from the foregoing that means is disclosed for quickly and easily moving bulkheads 15,16 from the FIG. 1 to the FIG. 3 position (and back again) to accommodate for wind turbulence on the flat beds of the cars when empty and the train is in motion. This prevents the cars from derailing when the train is in motion.

While it is preferred that a total of 4 pistons be employed, 2 per end of a car, 1 on each side, it is seen that only 1 piston per end is needed to orient a bulkhead. It is also within the skill of the art to connect a single position through a push rod system to operate both ends of the car in tandem.

Since certain changes may be made in the above apparatus without departing from the scope of the invention herein involved, it is intended that all matter contained in the above description and shown in the accompanying drawings shall be interpreted as illustrative and not in a limiting sense.

I claim:

1. In a railroad bulkhead flatcar having a flat bed and spaced bulkheads for enclosing material therebetween on said flat bed, the improvement which comprises:

bulkhead moving means coupled to each of said bulkheads for rotating each of said bulkheads from a first upright vertical position with respect to the plane of said flat bed downwardly and inwardly to a second position substantially parallel to the plane of said flat bed wherein said moving means comprises a pair of spaced upright members each of which is secured to the external side of said bulkhead, each of said upright members being interconnected at their lower ends by a rotating shaft fixedly secured to said upright members, and rotatably mounted on said car, and piston means mounted on said car operatively connected to at least one of said upright members to rotate same.

2. In the car of claim 1 including locking means associated with said upright members for locking the same in said first or second position.

3. In the car of claim 1 wherein said piston means is an air piston actuated by conventional air pressure of said railroad car.

4. In the car of claim 3 wherein each of said upright members includes a rounded bottom portion extending through slots in the bed of said car below the upper surface of said bed.

5. In the car of claim 4 wherein said air piston includes a piston rod fixedly secured to at least one of said rounded portions.

6. In the car of claim 1 wherein said upright members are counterbalanced.

7. In the flatcar of claim 1 wherein said flat bed includes aligned slots to permit the disposition of a portion of said upright members in said slots, a portion of each of said upright members extending down below said bed through said slots.

8. In the flatcar of claim 7 wherein said piston means is connected to at least one upright member below the surface of the flat bed.

* * * * *